US009175525B2

(12) United States Patent
Faye

(10) Patent No.: US 9,175,525 B2
(45) Date of Patent: Nov. 3, 2015

(54) DEVICE FOR HANDLING HOSES OF A WORKING WELL FOR A DRILLING RIG

(75) Inventor: Gunnar Sigurd Faye, Bergen (NO)

(73) Assignee: FRIGSTAD ENGINEERING LTD. (CY)

( * ) Notice: Subject to any disclaimer, the term of this patent is extended or adjusted under 35 U.S.C. 154(b) by 117 days.

(21) Appl. No.: 13/991,027

(22) PCT Filed: Dec. 1, 2011

(86) PCT No.: PCT/NO2011/000335

§ 371 (c)(1),
(2), (4) Date: May 31, 2013

(87) PCT Pub. No.: WO2013/074409

PCT Pub. Date: Jun. 7, 2012

(65) Prior Publication Data

US 2013/0240214 A1 Sep. 19, 2013

(30) Foreign Application Priority Data

Dec. 3, 2010 (NO) ..... 20101693

(51) Int. Cl.
*E21B 19/00* (2006.01)
*E21B 17/02* (2006.01)

(52) U.S. Cl.
CPC ..... *E21B 19/002* (2013.01); *E21B 17/02* (2013.01)

(58) Field of Classification Search
CPC ..... E21B 17/02; E21B 17/023; E21B 17/026; E21B 19/02; E21B 19/007; E21B 19/16
USPC ..... 166/379, 380, 381, 339, 340, 342, 343, 166/345, 347, 349, 365, 367
See application file for complete search history.

(56) References Cited

U.S. PATENT DOCUMENTS

| | | | | |
|---|---|---|---|---|
| 3,190,307 | A * | 6/1965 | De Vries | 137/355.17 |
| 4,081,163 | A * | 3/1978 | Guinn et al. | 248/637 |
| 5,823,837 | A * | 10/1998 | Boatman et al. | 441/5 |
| 5,846,028 | A | 12/1998 | Thory | 405/195.1 |
| 6,920,931 | B1 | 7/2005 | Webre et al. | |
| 8,875,793 | B2 * | 11/2014 | Christensen et al. | 166/345 |
| 2005/0161225 | A1 | 7/2005 | Cole et al. | |
| 2005/0161230 | A1 | 7/2005 | Webre et al. | |
| 2014/0166299 | A1 * | 6/2014 | Vatne | 166/360 |

FOREIGN PATENT DOCUMENTS

| | | |
|---|---|---|
| NO | 20093312 | 5/2011 |
| WO | WO 2006 058055 A2 | 6/2006 |

OTHER PUBLICATIONS

International Search Report dated Mar. 15, 2013 issued in corresponding International patent application No. PCT/NO2011/000335.
Written Opinion dated Mar. 15, 2013 issued in corresponding International patent application No. PCT/NO2011/000335.
Korean Office Action dated Mar. 25, 2015 issued in Korean Application No. 10-2013-7013663.

* cited by examiner

*Primary Examiner* — James G Sayre
(74) *Attorney, Agent, or Firm* — Ostrolenk Faber LLP

(57) ABSTRACT

A manipulator device (4) arranged to move a hose manifold (13) as one or more hoses (12) is/are being connected to and disconnected from pipelines (11) arranged on a marine riser (1), the manipulator (4) being fixed to an undercarriage (3) which is movable relative to a working well (21).

3 Claims, 3 Drawing Sheets

DEVICE FOR HANDLING HOSES OF A WORKING WELL FOR A DRILLING RIG

CROSS REFERENCE TO RELATED APPLICATIONS

The present application is a 35 U.S.C. §371 National Phase conversion of PCT/NO2011/000335, filed Dec. 1, 2011, which claims benefit of Norwegian Application No. 20101693, filed Dec. 3, 2010, the disclosure of which is incorporated herein by reference. The PCT International Application was published in the English language.

BACKGROUND OF THE INVENTION

1. Technical Field

A manipulator device is described, arranged to move a hose manifold as one or more hoses is/are being connected to and disconnected from pipelines arranged on a marine riser at a floating field installation with one or more well centres.

2. Related Art

Between a marine riser which is anchored to a seabed and a floating installation moving with the waves, fluids are carried in hoses. Conventionally, one end of the hoses is connected to the riser via pipe bends, so-called goosenecks, near to a telescopic riser element. The other end of the hoses will be firmly connected to the floating installation, hanging in a loop down around the upper portion of the riser. The connection of hoses is, to a great degree, carried out manually by means of one or more operators hanging on a belt in the so-called moon-pool area, called the working well in the further description, the operations being greatly exposed to the influence of wind and waves and also adjacent structures.

Mechanical systems are also known, for example the ROPS (Remote Operated Pull-in System) from Sub Sea Services AS, Stavanger, Norway, in which the hoses are connected to a hose manifold provided with several goosenecks, each connected to a hose, and in which quick-release couplings provide for releasable connection between the gooseneck and a pipe socket on the riser. In the connection phase, the hose manifold is manoeuvred by a first manipulator which is arranged on the riser, and the hose manifold is moved towards or away from the riser by means of a second manipulator arranged near the working well.

The prior art technique entails hoses and handling equipment taking up space around the riser centre and the working well, which is obstructive to handling other equipment to be used in the well operations.

The invention has for its object to remedy or reduce at least one of the drawbacks of the prior art, or at least provide a useful alternative to the prior art.

The object is achieved through features which are specified in the description below and in the claims that follow.

SUMMARY OF THE INVENTION

A device for handling a hose manifold arranged to releasably connect one or more hoses to a marine riser extending between a well installation on a seabed and a floating installation on a sea surface is provided. The device includes at least one manipulator connected to an undercarriage which is horizontally movable relative to a working-well opening on the floating installation. The undercarriage is preferably a carriage, for example a transportation skid arranged to carry a blowout preventer (BOP).

The invention relates, more specifically, to a manipulator device arranged to move a hose manifold as one or more hoses is/are being connected to and disconnected from pipelines arranged on a marine riser, characterized by the manipulator being fixed to an undercarriage which is movable relative to a working well.

The undercarriage may be a carriage arranged on a deck bordering on the working well.

The undercarriage may be connected to a supporting structure for a well element or a well tool.

The manipulator may have three translatory degrees of freedom, first and second degrees of freedom being assigned to the manipulator arm and a third degree of freedom being assigned to the undercarriage.

BRIEF DESCRIPTION OF THE DRAWINGS

In what follows is described an example of a preferred embodiment which is visualized in the accompanying drawings, in which.

DESCRIPTION OF PREFERRED EMBODIMENTS

Figure 1:
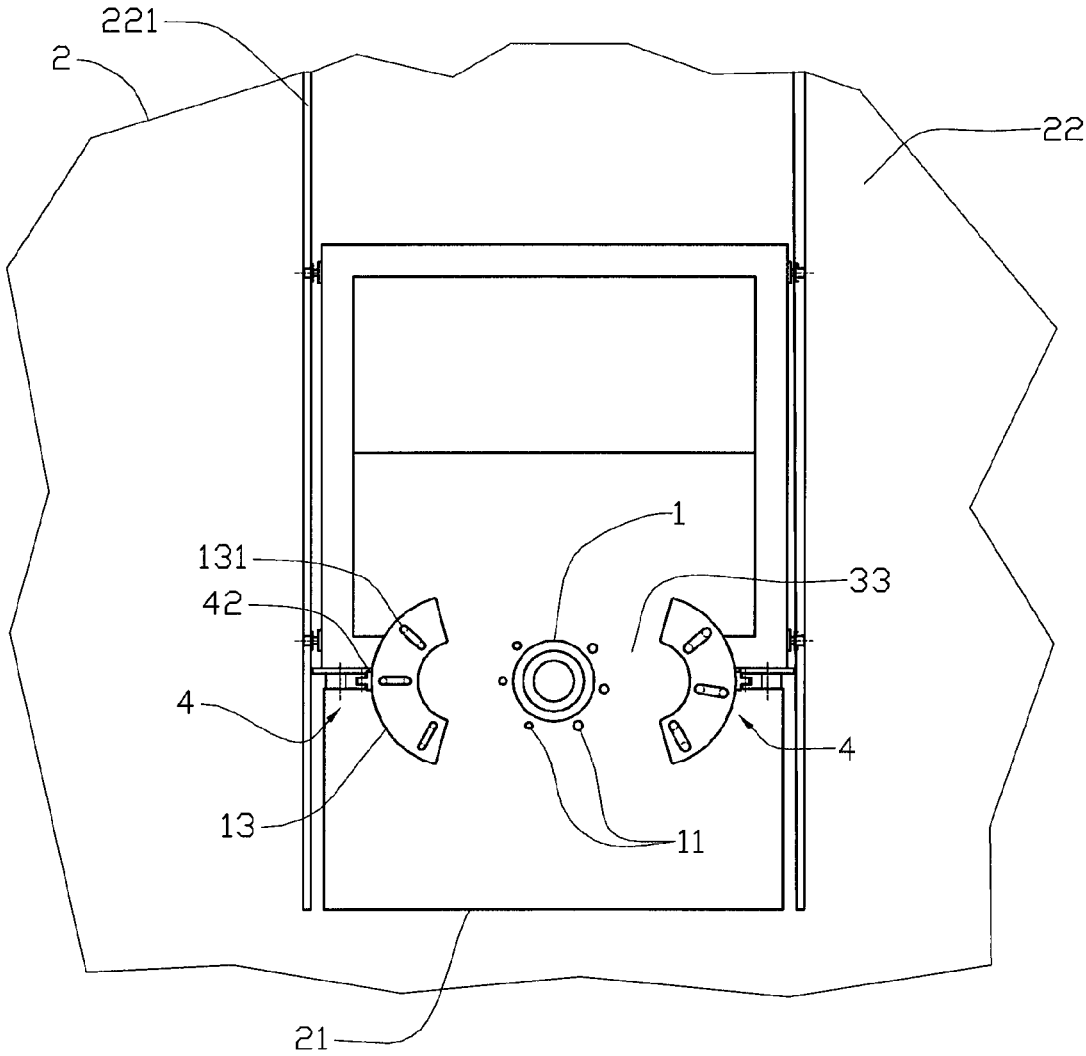
FIG. 1 shows schematically a plan of a section of a working-well area, in which two hose manifolds are positioned near a riser by means of a carriage provided with two manipulators.

In the figures, the reference numeral 1 indicates a riser extending, in a manner known per se, from a subsea well-head (not shown) and up through a working well 21 on a field installation 2 floating on a sea surface (not shown). The working well 21 is defined by a deck 22.

Along the outside of the riser 1, several pipelines 11 extend in a manner known per se, for example for the conveyance of hydraulic fluid to a subsea blowout preventer (not shown). Each of the pipelines 11 is provided, in a manner known per se, with a connecting piece 111 arranged for releasable connection via a gooseneck 131 to a hose 12 hanging in a curve from a hose manifold 13 carrying several goosenecks 131 and being provided with suitable connection and locking elements (not shown) to hold the hose manifold 13 fixed to the riser 1. A connection between the pipeline 11 and the field installation 2 past a telescopic riser section, here indicated by the reference numeral 34, is thereby provided, which is necessary to provide a riser connection which is not disturbed by the heaving motion of the field installation 2.

Figure 3:
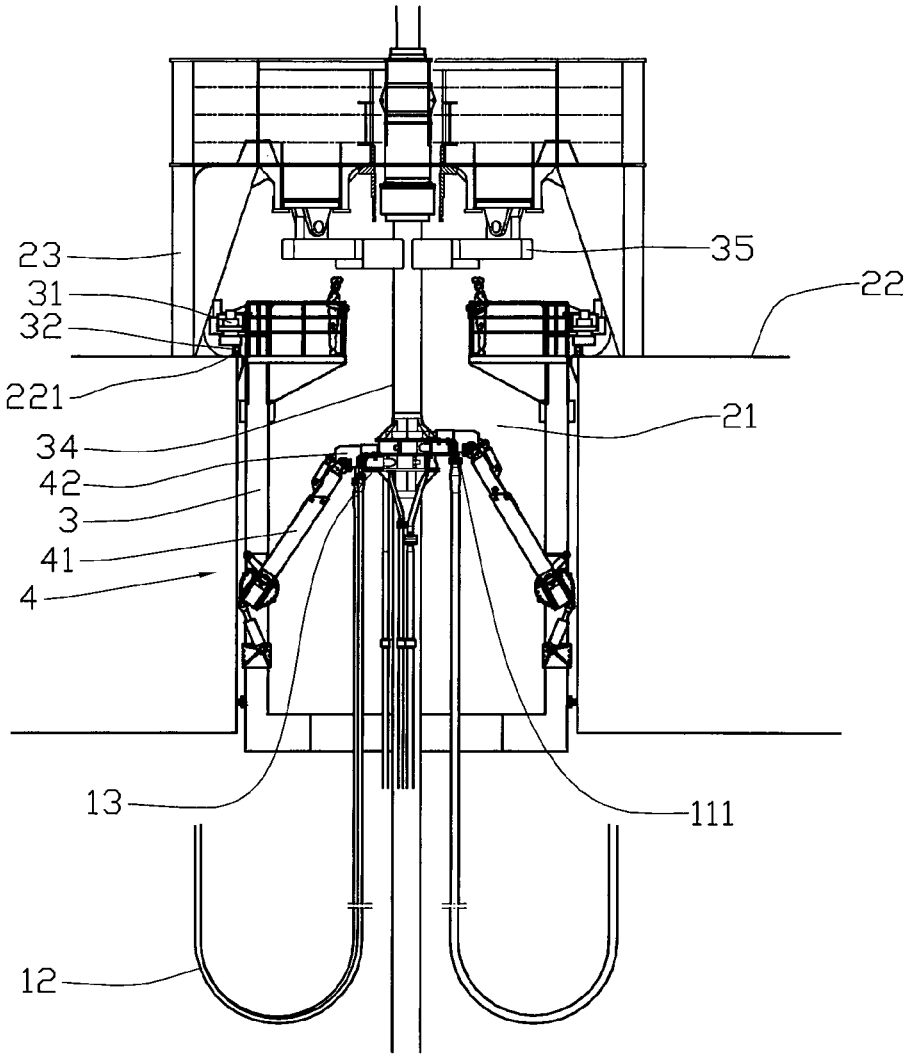
FIG. 3 shows, on a larger scale and in more detail, an example of a carriage provided with two manipulators in a situation in which the pipe manifolds are connected to the riser.

A supporting structure 23 is arranged at the working well 21 for the suspension of various well elements and well tools, indicated in FIG. 3 by the reference numerals 34 and 35.

An undercarriage 3 is arranged horizontally movable between a position above the working well 21 and a position in which the undercarriage 3 is positioned outside the working well 21, the undercarriage 3 being provided with a drive 31 comprising wheels 32 which can roll on suitable tracks 221, shown in FIG. 3 as rails arranged on the deck 2.

Figure 2:
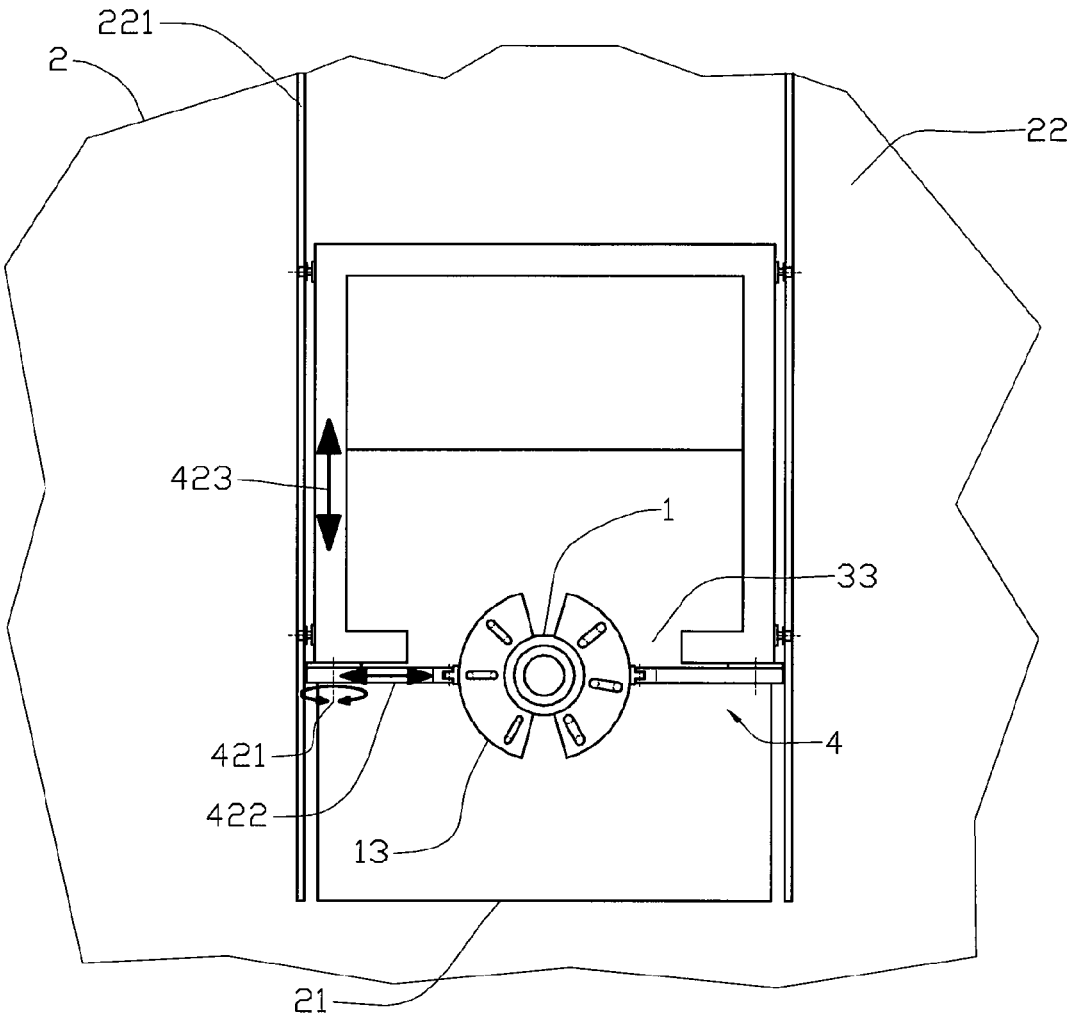
FIG. 2 shows the hose manifolds moved in towards the riser and connected to it.

The undercarriage 3 has an approximately C-shaped ground plan with a front opening 33 which provides a possibility of moving the undercarriage 3 in an axial direction indicated by an arrow 423 (see FIG. 2) into a position in which it encloses a portion of the riser 1. At the side portions of the front opening 33, two manipulators 4 are arranged, each provided with a manipulator arm 41 rotatable around a horizontal axis 421 and telescopically extendable in an axial direction indicated by an arrow 422 (see FIG. 2). The manipulator arm 41 is provided with a gripping device 42 forming an interface between the manipulator 4 and coupling elements (not shown) on the hose manifold 13, the hose manifold 13 being disengageable from the manipulator 4 when necessary.

Whenever there is a need to disconnect the hoses 12 from the riser 1, the undercarriage 3 is moved in over the working well 21 by means of the drive 31 into a position in which the gripping devices 42 of the manipulator 4 are positioned right opposite the coupling elements, not shown, of the hose manifolds 13. The manipulator arms 41 are adjusted into engagement with the hose manifolds 13 which is then disconnected from the connecting pieces 111 on the pipelines 11 as the hose manifolds are pulled away from the riser 1 and out towards the outer edges of the working well 21. The undercarriage 3 is moved away from the riser 1 so that the hose manifolds 13 and the hoses 12 are located far from the centre area of the working well 21. Other work on and around the riser 1 may thereby take place unobstructed by the hose manifolds 13.

Even though, in the exemplary embodiment, an undercarriage 3 with two manipulators 4 is shown, it is within the scope of the invention to provide the undercarriage 3 with a different set-up of manipulators 4 arranged to handle elements connected to the riser 1.

What is claimed is:

1. A manipulator device arranged to move a hose manifold as one or more hoses is/are being connected to and disconnected from pipelines arranged on a marine riser, the manipulator being fixed to an undercarriage which is movable relative to a working well, wherein the undercarriage is a carriage arranged on a deck bordering on the working well, and wherein the manipulator has three translatory degrees of freedom, first and second degrees of freedom being assigned to a manipulator arm and a third degree of freedom being assigned to the undercarriage by horizontal displacement of the undercarriage.

2. The device in accordance with claim 1, wherein the undercarriage is arranged on a deck bordering on the working well horizontally movable between a position above the working well and a position in which the undercarriage is positioned outside the working well.

3. The device in accordance with claim 1, wherein the undercarriage is connected to a supporting structure for a well element or a well tool.

* * * * *